US008978210B2

(12) United States Patent
Arjomand

(10) Patent No.: US 8,978,210 B2
(45) Date of Patent: Mar. 17, 2015

(54) ADJUSTABLE-LENGTH TIE-WRAP

(76) Inventor: Ataullah Arjomand, Bellevue, WA (US)

( * ) Notice: Subject to any disclaimer, the term of this patent is extended or adjusted under 35 U.S.C. 154(b) by 293 days.

(21) Appl. No.: 12/698,547

(22) Filed: Feb. 2, 2010

(65) Prior Publication Data

US 2011/0225777 A1 Sep. 22, 2011

(51) Int. Cl.
*B65D 63/00* (2006.01)
*B65D 63/14* (2006.01)

(52) U.S. Cl.
CPC ..... *B65D 63/14* (2013.01); *Y10T 29/49826* (2013.01); *Y10T 24/14* (2013.01)
USPC ..... 24/16 PB; 24/16 R; 24/17 AP; 24/19

(58) Field of Classification Search
CPC ..... B65D 63/1072; B65D 63/14; B65D 63/1081; B65D 63/16; B65D 63/1036; B65D 63/1063; B65D 2563/103; B65D 2563/105; B65D 2563/106; B65D 2563/107; B65D 2563/108; B65D 33/1616; F16L 3/2334
USPC ..... 24/16 PB, 16 R, 17 AP, 19, 30.5
See application file for complete search history.

(56) References Cited

U.S. PATENT DOCUMENTS 3,102,311 A * 9/1963 Martin et al. ..... 24/16 PB
3,224,056 A * 12/1965 Joffe ..... 24/16 R
3,654,669 A * 4/1972 Fulton ..... 24/16 PB
3,747,164 A * 7/1973 Fortsch ..... 24/16 PB
4,287,644 A * 9/1981 Durand ..... 24/16 PB
4,574,434 A * 3/1986 Shupe et al. ..... 24/16 PB
4,680,834 A * 7/1987 Andre et al. ..... 24/16 PB
5,102,075 A * 4/1992 Dyer ..... 248/61
5,121,524 A * 6/1992 Mortensen ..... 24/16 PB
5,224,244 A * 7/1993 Ikeda et al. ..... 24/16 PB
5,377,387 A * 1/1995 Freed ..... 24/16 PB
5,544,391 A * 8/1996 Hoffman ..... 24/16 PB
5,653,409 A * 8/1997 White et al. ..... 248/73
5,758,390 A * 6/1998 Villeneuve ..... 24/16 PB
5,911,368 A * 6/1999 Davignon ..... 24/16 PB
5,956,813 A * 9/1999 Cooper ..... 24/16 PB
6,185,792 B1 * 2/2001 Nelson et al. ..... 24/16 PB
6,532,631 B2 * 3/2003 Rohaly et al. ..... 24/16 PB
6,658,703 B1 * 12/2003 Teagno et al. ..... 24/16 PB
6,718,598 B2 * 4/2004 Gorman et al. ..... 24/30.5 W
6,928,701 B2 * 8/2005 Hutter, III ..... 24/16 PB
2002/0104196 A1 * 8/2002 Geiger ..... 24/16 PB
2007/0234524 A1 * 10/2007 Witt ..... 24/16 PB
2009/0077773 A1 * 3/2009 Harrington et al. ..... 24/16 PB

* cited by examiner

*Primary Examiner* — Robert J Sandy
*Assistant Examiner* — David Upchurch
(74) *Attorney, Agent, or Firm* — Arjomand Law Group

(57) ABSTRACT

Tie-wraps of practically infinite length are disclosed that can be cut to any desirable size at the time of use. These tie-wraps allow wrapping of any size object and comprise a flexible strap part and a locking part, both of which can be reused numerous times. To use the tie-wrap, the user cuts a piece from the flexible strap bundle and inserts its ends into a locking part and pulls one or both ends of the strap until it is tightly wrapped around the object. In other embodiments the ends of the strap may enter the locking part from one side or from multiple sides. In alternative embodiments the locking part or the strap may have a single pawl or multiple pawls which are made of plastic, metal, or other materials. Disclosed tie-wraps may be used, in addition to wrapping, to form handles or tag holders for the wrapped object.

3 Claims, 8 Drawing Sheets

Fig. 6A
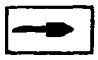
Fig. 6B
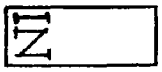
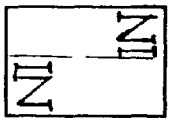
Fig. 6C
Fig. 6D
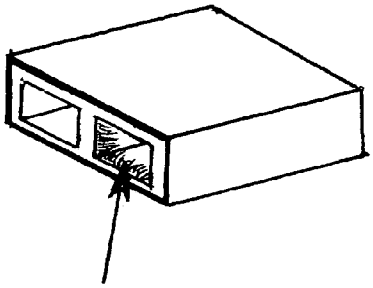
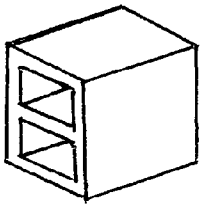
Fig. 7A
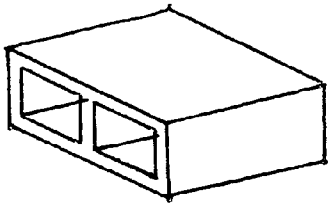
Fig. 7B
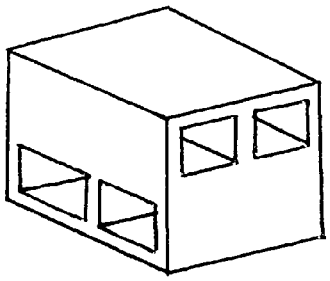
Fig. 7C
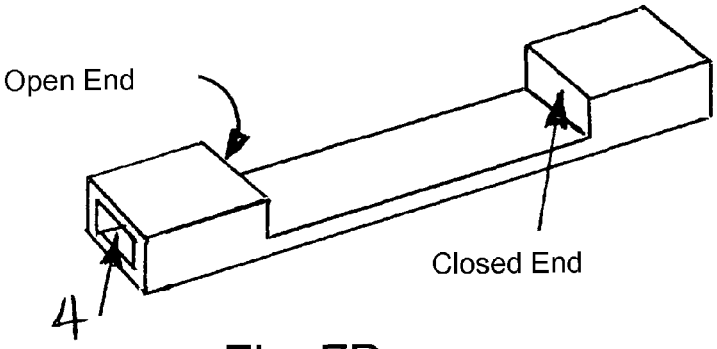
Fig. 7D

ADJUSTABLE-LENGTH TIE-WRAP

TECHNICAL FIELD

The disclosed embodiments relate, in general, to packing and Packaging and, in particular, to flexible tie-wraps.

BACKGROUND

Tie-wraps, also known as cable-ties and harnessing devices, are typically molded plastic devices that have a strap and a head piece and are commonly used for securely wrapping a box or package, and also for holding together a bundle of objects, such as wires or cables, among other common wrapping applications. In most tie-wraps the strap has a rack or series of transverse teeth extending along the length of the strap. The head piece may include a strap receiving channel in the form of an opening that contains a pawl, in the form of a catch or a protrusion, which mates with and ratchets over the rack of teeth on the strap. The end of the strap is inserted through the opening to form a closed loop that can be pulled to tighten and reduce the diameter of the closed loop. As the strap tightens, the pawl locks into the teeth to prevent the strap from loosening. An example of such a cable tie, shown in FIG. 1, is found in U.S. Pat. No. 3,605,199. Some tie-wraps use sharp metal pawls which engage the plastic strap even when the strap does not have teeth.

Tie-wraps serve different uses ranging from automobile construction to bundling wires, to almost anything else which might require a strap tied around it. The wide-spread use of cable ties attests to their reliability, convenience, and overall utility. Nevertheless, problems persist. For example, the length of a tie-wrap limits the ability to wrap an object the circumference of which is larger than the length of the tie-wrap. For this reason a user needs to carry batches of different length tie-wraps. And if even the longest available tie-wrap is not sufficient, the user must attach several tie-wraps together to form a longer tie-wrap for wrapping the object. In addition, the traditional tie-wraps are designed for one-time use, which waste a number of resources and negatively impact the environment.

Therefore, there is a need for a reusable tie-wrap that can be adjusted to any desirable length to wrap around any size object or to wrap an object more than once.

BRIEF DESCRIPTION OF THE DRAWINGS

Subject matter is particularly pointed out and distinctly claimed in the concluding portion of the specification. The foregoing and other features of this disclosure will become more fully apparent from the following description and appended claims, taken in conjunction with the accompanying drawings. Understanding that these drawings depict only several embodiments in accordance with the disclosure and, therefore, are not to be considered limiting of its scope, the disclosure will be described with additional specificity and detail through use of the accompanying drawings. Various embodiments will be described referencing the accompanying drawings in which like references denote similar elements, and in which:

FIG. 5B shows two strap ends entering a first locking head from a same side of the locking head and move through the locking head in a same direction, while

FIGS. 6A to 6D shows sample arrangements for entering ends of a locking head such as a funnel configuration, markings by colors, letters, arrows, or any other means, or a combination thereof, so that the user easily knows where to insert the strap ends.

FIGS. 7A, 7B, and 7C show two 2-entry locking heads and one 4-entry locking head, while FIG. 7D shows that in some embodiments, called "distant passages," not all the strap passages have exit holes or are adjacent to each other.

FIG. 8A illustrates a cross-section of a strap passage through which a single strap end 2 can pass, while

DETAILED DESCRIPTION

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order-dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other via one or more intermediate elements or components.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB), that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Figure 1:
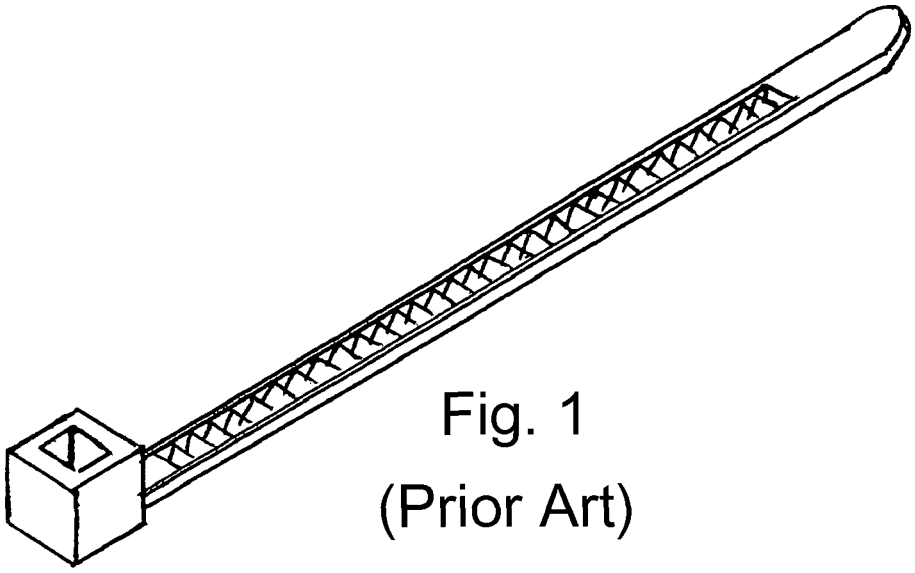
Fig. 1 (Prior Art)
FIG. 1 illustrates a prior art tie-wrap.

The existing tie-wraps come in specific prefabricated lengths, and each tie-wrap is composed of a strap and a head (locking head) attached to it. These tie-wraps are usually not longer than 15 inches. FIG. 1 illustrates a typical tie-wrap. If the circumference of an object to be wrapped is more than the length of the tie-wrap, such as a large box or a luggage, the user may have to attach a few tie-wraps end-to-end together by inserting the end of each tie-wrap into the head of another tie-wrap until a tie-wrap of desired size is assembled. Doing so wastes several heads and a part of every tie-wrap, and creates an unappealing appearance. In addition it wastes user's time and effort.

Figure 2A:
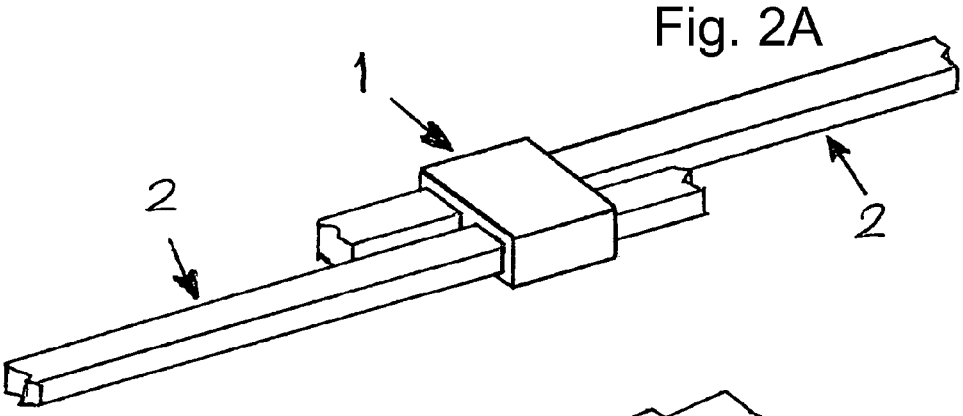
FIGS. 2A, 2B, and 2C show sample straps and locking heads in accordance with three embodiments of the invention.
Figure 2B:
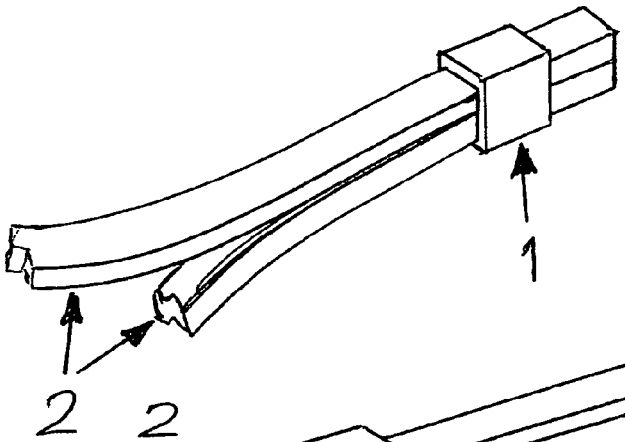
Figure 2C:
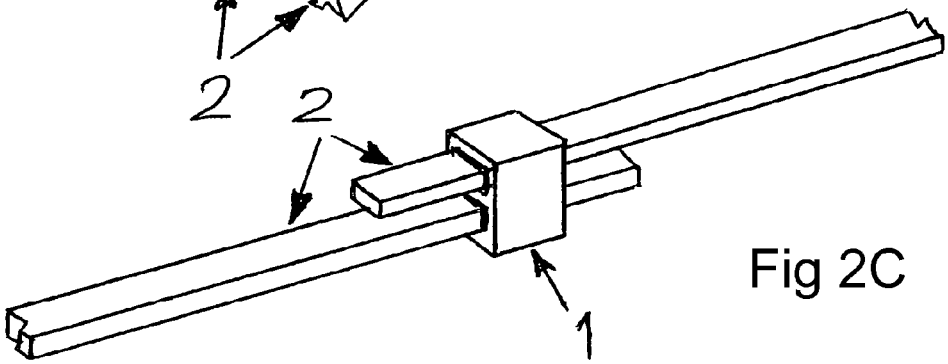

Generally stated, aspects of the present disclosure are directed to a strap of any uniform or varying cross-section, such as a rectangular cross-section or a round cross-section, and a locking head that is not an integral part of or physically connected to the strap. For example, an embodiment comprises a strap of adequately long length for multiple wrapping occasions plus physically separate individual locking head pieces. Each locking-head, along with a cut segment of the long strap to an unpredetermined length, may be used for one wrapping application. In this example, to tie an object or several objects together, a user can cut a piece of the strap to any arbitrary size, long enough to serve his/her purpose, and tighten it around the object(s) by inserting the two ends of the strap piece in a locking head and pulling one or both ends until the strap is tight enough around the object. If desired, the user can wrap a strap of sufficient length several times around the object(s) before inserting its ends into the locking head. FIGS. 2A, 2B, and 2C show three different sample straps 2 and locking heads 1.

Another advantage of the disclosed embodiments is that, unlike the prior art tie-wraps which can be used only once, both the disclosed straps and the locking heads can be reused over and over again. For example, after cutting a tied strap from around a previously wrapped package, the strap can be pulled out of the locking head in the same direction as it had entered the locking head and both the strap and the locking head be reused to wrap another package.

Unlike some traditional wrapping apparatuses and methods, the disclosed embodiments do not require any apparatus, for example for crimping the locking head to restrict the movement of the strap within the locking head or for tightening the strap around the object. However, the use of special or conventional tools can help with further tightening of the straps around objects and packages.

In some embodiments, for example as depicted in FIGS. 3A through 3D, the locking mechanisms within the locking heads 1 use one or more pawls 3 that allow effortless passage of the strap through the locking head 1 in one direction but strongly resist the strap movement in an opposite direction. In one embodiment the movement of the strap end may be restricted by a single pawl 3, in another embodiment by multiple pawls 3, and in yet another embodiment by a combination of both, for example one pawl 3 in one passage way 4 and multiple pawls in another passage way 4. In yet another embodiment the pawls 3 in one passage way 4 may protrude from more than one side of the passage way 4. These pawls 3 may be manufactured as an integral part of the locking heads 1, for example as a molded part of a plastic locking head 1, or be a separate piece added to the locking head 1 enclosure such as a metal pawl 3 embedded into a plastic locking head 1 enclosure. The pawls 3 may also protrude from any one side or multiple sides of the strap passage ways 4. Other mechanisms may be used to restrict the movement of the straps within the locking heads 1.

Figure 3A:
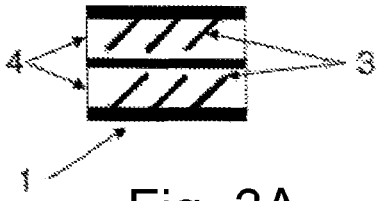
FIGS. 3A, 3B, 3C, and 3D illustrate a cross-sectional view of a locking head that uses one or more pawls per strap passage and allow effortless passage of the strap through the locking head in one direction but resist the strap movement in an opposite direction, in accordance with embodiments of the invention.
Figure 3B:
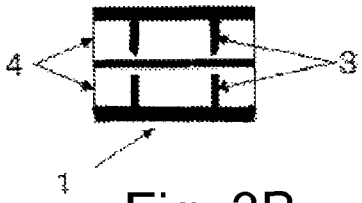
Figure 3C:
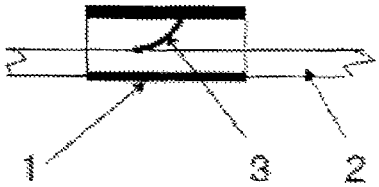
Figure 3D:
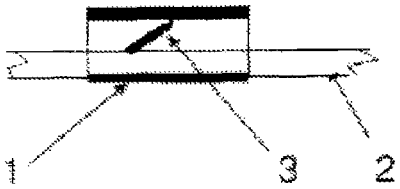

In some embodiments, as shown in FIG. 3B, the strap may enter a passage way 4 of the locking head 1 from either side. Such embodiments make it easier for the users to utilize the locking heads 1 without the need to insert the strap into any particular end of and/or in a predetermined direction through the passage way 4. In some embodiments, as shown in FIG. 3C, pawls 3 may be bendable and be curved when the strap is pushed through the passage way 4 from either end. In other embodiments pawls 3 may be rigid but hinged at their connection point to the passage way 4 so that the pawls bend and swivel around their respective hinges when pushed through the passage way 4. An example of an inexpensive hinge is a weak point in the pawl material at the point of connection to the passage way wall, as shown in FIG. 3D. In this embodiment, the pawl swings or pivots from its base in the direction of the insertion of the strap without the deformation or bending of the pawl body which engages the strap.

Figure 4A:
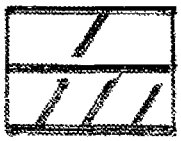
FIGS. 4A and 4B illustrate two cross-sections of a multiple-pawl locking head that uses pawls along the length of the strap passage way as well as across the width of the strap passage way, in accordance with another embodiment of the invention.
Figure 4B:
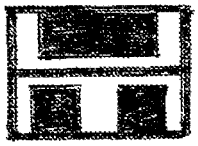

The pawls 3 in multiple-pawl locking heads 1 may be situated along the length of the strap passage way 4 or across the width of the strap passage way 4, or both, as depicted in FIGS. 4A and 4B.

Figure 5A:
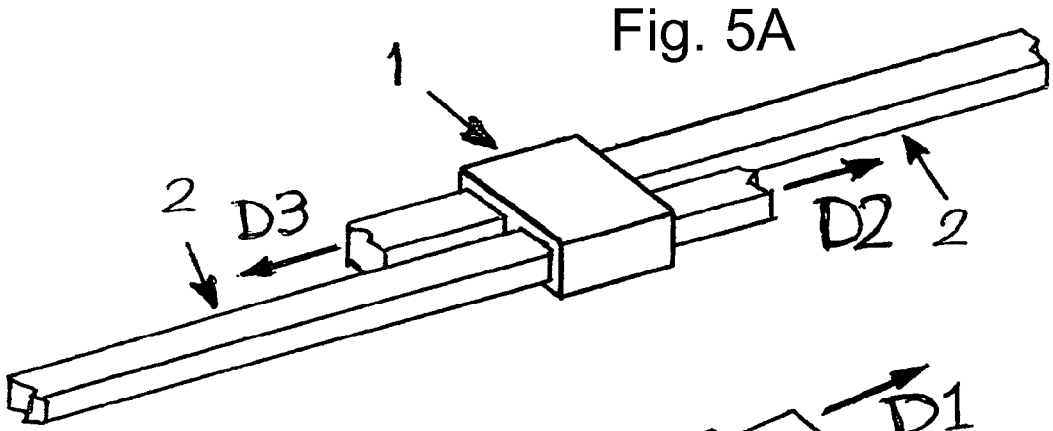
FIG. 5A shows the two strap ends entering a second locking head from different sides and move through the locking head in different directions, in accordance with yet another embodiment of the invention.
Figure 5B:
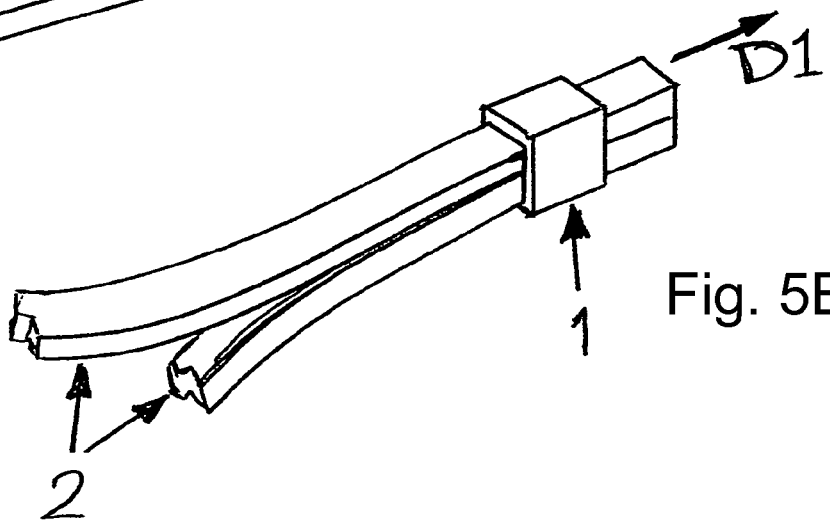

In some embodiments, as shown in FIG. 5B, the ends of one strap piece may enter a locking head from the same side of the locking head and move through the locking head in the same direction D1 while in another embodiment, as shown in FIG. 5A, the ends of the strap piece enter the locking head from different sides and move through the locking head in different directions D2 and D3. The entering end(s) of a locking head, as depicted in FIGS. 6A-6D, may be formed in a funnel configuration or be marked, such as by colors, letters, arrows, or any other means, or a combination thereof, so that the user easily recognizes where to insert the strap ends.

In some embodiments a locking head may have one or multiple entrances for ends of multiple strap pieces and/or one or multiple exits for ends of multiple strap pieces. For example, FIGS. 7A, 7B and 7C show two different 2-entry locking heads and one 4-entry locking head. Different locking heads, such as the ones depicted in FIG. 7, may be manufactured for different purposes, for example, for wrapping an object with a wrap loop in a single plane or with multiple wrap loops in multiple planes. As depicted in FIG. 7D, neither the strap passages 4 of a locking head need to be adjacent to each other nor do they all need to have exit holes.

Figure 8A:
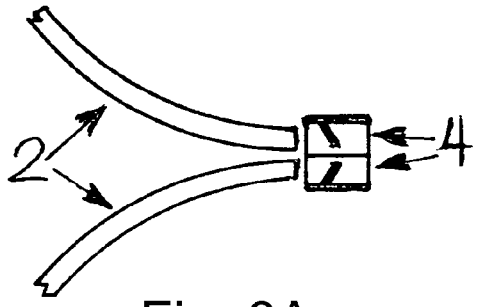
Figure 8B:
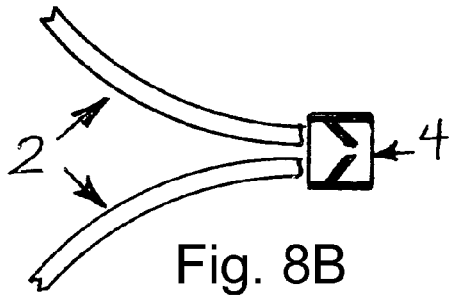
FIG. 8B shows a cross-section of a strap passage through which multiple strap ends 2 can pass, in accordance with another embodiment of the invention.

In one embodiment, such as the one shown in FIG. 8A, a strap passage 4 through the locking head only allows the passage of a single strap end 2, while in an alternative embodiment, shown in FIG. 8B, a strap passage 4 through the locking head allows the passage of more than one strap end 2.

Figure 9A:
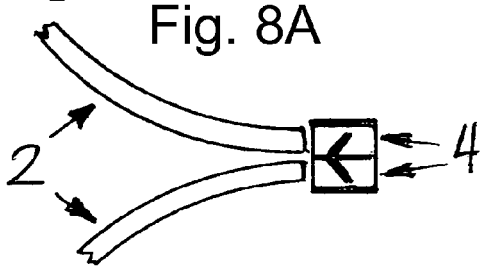
FIGS. 9A to 9C shows that in some embodiments one or both sides of straps are smooth and in other embodiments one or both sides of the straps are unsmooth, to create additional friction or "grab" with pawls and/or strap passage walls.
Figure 9B:
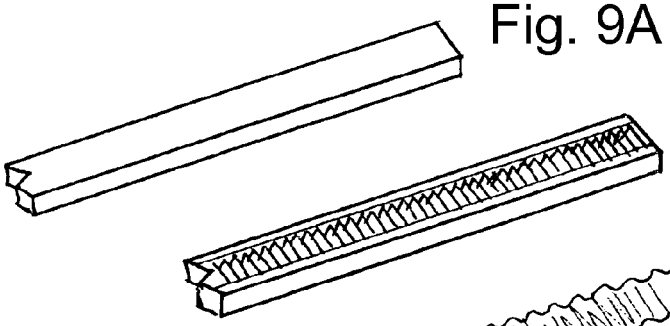
Figure 9C:
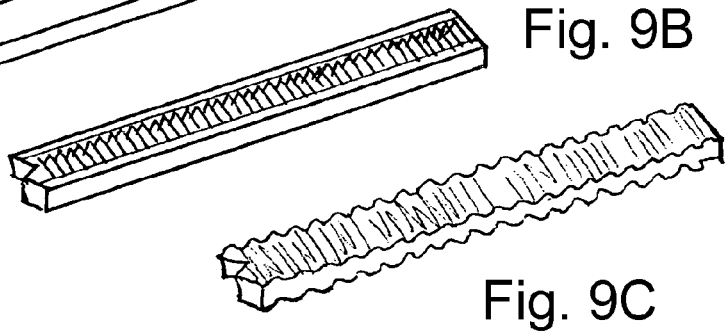

As shown in FIGS. 9A-9C, in some embodiments one or both sides of the straps are smooth and in other embodiments one or both sides of the straps are unsmooth to create additional friction or "grab" with the pawl and/or the passage wall(s).

Figure 10A:
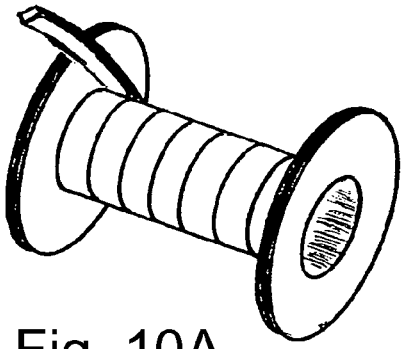
As shown in FIGS. 10A and 10B, for efficient packaging, a strap may be wound around a spool or just wrapped in a loop or packaged in any other way, in accordance with another embodiment of the invention.
Figure 10B:
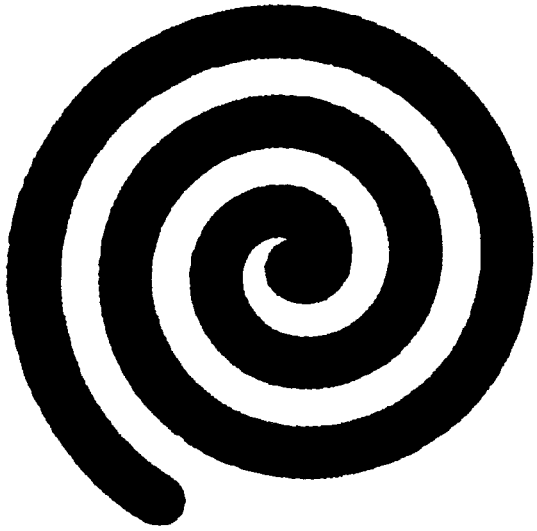
Figure 11:
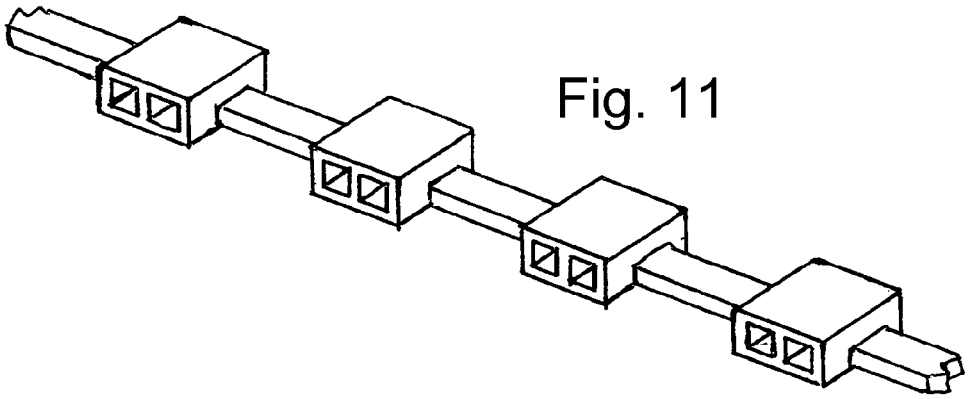
FIG. 11 shows locking heads that are manufactured attached to each other and are easily separable by hand or by scissors, wound around a spool or wrapped in a loop configuration, in accordance with another embodiment of the invention.

For efficient packaging a strap may be wound around a spool or just wrapped in a loop as shown in FIGS. 10A and 10B, or packaged in any other way. The locking heads may also be manufactured individually, attached to each other in a strip or in any other form, as depicted in FIG. 11, but easily separable by hand or by scissors. A locking head strip can also be wound around a spool or wrapped in a loop form.

Figure 12:
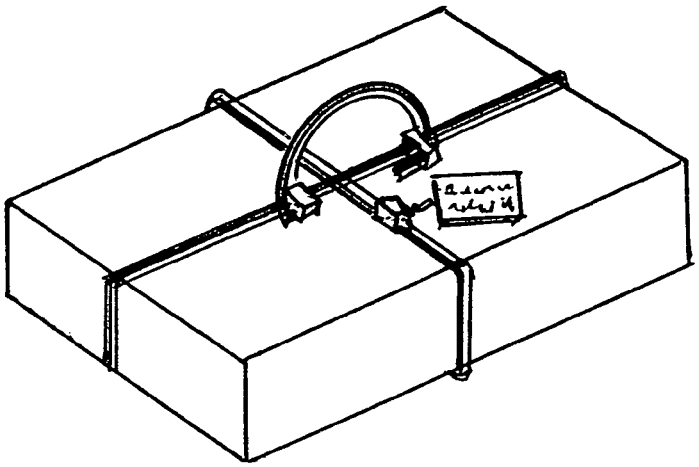
FIG. 12 shows locking heads and straps are used to form a handle for a wrapped box or to form a tag holder, in accordance with another embodiment of the invention.

In some embodiments the locking heads and the straps may serve additional purposes. For example, as shown in FIG. 12, they are used to form a handle for a wrapped box or to form a tag holder. In some embodiments locking heads may be attachable separate pieces or be integral parts of other accessories such as handles and tags. Locking heads may be manufactured with different looks and colors, such as a red flower, for easy identification of one's luggage in airports and train stations.

In one embodiment the strap may have pawls that engage a notched or ribbed surface of the locking head, while the locking head itself may not have any pawls.

Figure 13:
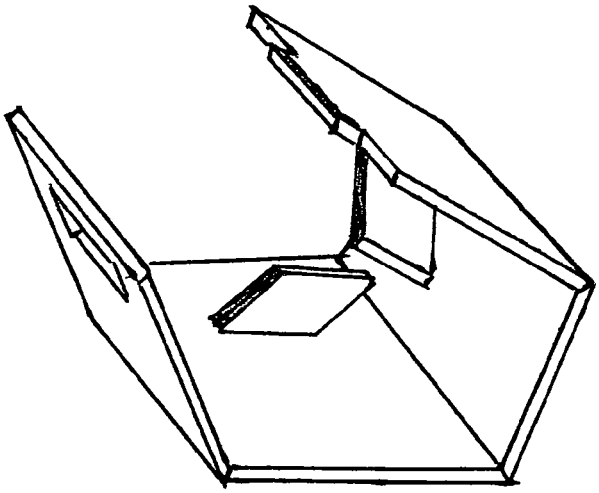
FIG. 13 shows an embodiment in which locking heads can be opened to release the straps within them, in accordance with another embodiment of the invention.

As shown in FIG. 13, in some embodiments the locking heads are configured to be able to open or close to release or hold/grab the strap, respectively. Numerous known mechanisms may be used for closing and/or opening a locking head.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention and the invention can be practiced in many ways, as those skilled in the relevant art will recognize. The teachings provided herein can also be applied to other systems, not necessarily the system described herein. The elements and acts of the various embodiments described above can be combined to provide further embodiments.

As noted above, particular terminology used when describing certain features or aspects of the invention should not be taken to imply that the terminology is being redefined herein to be restricted to any specific characteristics, features, or aspects of the invention with which that terminology is associated.

All of the above patents and applications and other references, including any that may be listed in accompanying filing papers, are incorporated herein by reference.

Where the context permits, words in the above Detailed Description using the singular or plural number may also include the plural or singular number respectively.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention. When the claims use the word "or" in reference to a list of two or more items, that word covers all of the following interpretations of the word: any of the items in the list, all of the items in the list and any combination of the items in the list.

I claim:

1. A wrapping apparatus for wrapping objects of any size, the apparatus comprising:

a strap configured to be cut to a size of an object to be wrapped;

a locking head having a passage way, wherein the passage way has a first end and a second end;

a pawl within the passage way of the locking head configured to turn or bend in both directions toward the first or the second end of the passage way; and wherein each end of the strap is configured to enter either end of the passage way and force the pawl to bend or turn toward the other end of the passage way and wherein the bent or turned pawl is configured to engage the strap and prevent the strap from moving backward.

2. The wrapping apparatus of claim 1, wherein the locking head uses one or more pawls within the passage way to restrict the strap movement within the locking head.

3. A wrapping apparatus for wrapping an object, the apparatus comprising:

a strap with two ends;

a locking head having a passage way with a first and second entrance;

a pawl within the passage way configured to bend or swivel around a hinge; and wherein each end of the strap, at a plurality of orientations around a longitudinal axis of the strap, is configured to enter the first or the second entrance of the passage way and bend or swivel the pawl away from the first or the second entrance of the passage way, respectively, and wherein the bent or swiveled pawl is configured to engage the strap and restrict movement of the strap to a direction from the entrance at which the strap enters the passage way of the locking head to the other entrance of the passage way.

* * * * *